US006738022B2

(12) United States Patent
Klaavo et al.

(10) Patent No.: US 6,738,022 B2
(45) Date of Patent: May 18, 2004

(54) METHOD FOR TUNING AN ANTENNA AND AN ANTENNA

(75) Inventors: Heikki Klaavo, Varjakka (FI); Jarmo Pyykkö, Oulu (FI)

(73) Assignee: Filtronic LK Oy, Kempele (FI)

( * ) Notice: Subject to any disclaimer, the term of this patent is extended or adjusted under 35 U.S.C. 154(b) by 46 days.

(21) Appl. No.: 10/122,701

(22) Filed: Apr. 11, 2002

(65) Prior Publication Data

US 2002/0154063 A1 Oct. 24, 2002

(30) Foreign Application Priority Data

Apr. 18, 2001 (FI) ..... 20010797

(51) Int. Cl.[7] ..... H01Q 1/38
(52) U.S. Cl. ..... 343/700 MS; 343/702
(58) Field of Search ..... 343/700 MS, 702, 343/703

(56) References Cited

U.S. PATENT DOCUMENTS 5,588,198 A 12/1996 Kawahata et al. ..... 29/600
6,154,175 A * 11/2000 Yee ..... 343/700 MS

FOREIGN PATENT DOCUMENTS

JP 5 121925 A1 5/1993
JP 5 145328 A1 6/1993
JP 5 152831 A1 6/1993
JP 9 307340 A1 11/1997
JP 9307340 11/1997 ..... H01Q/13/08
JP 11136023 5/1999 ..... H01Q/13/08

OTHER PUBLICATIONS

E. Navarro et al., "Synthetic dielectrics 1 for planar antenna design", Electronics Letters, IE Stevenage, GB, vol. 36, No. 6, Mar. 16, 2000, pp. 491–493.

* cited by examiner

*Primary Examiner*—Michael C. Wimer
(74) *Attorney, Agent, or Firm*—Darby & Darby

(57) ABSTRACT

The invention relates to a method for tuning dielectric antennas designed for operation especially in the microwave range, and an antenna structure. An antenna is tuned by removing material (211) from a dielectric block (210) located between conductive elements, whereby the resonance frequency of the antenna increases. The conductive elements (220, 230) on opposing surfaces of the dielectric block are advantageously shaped identical and located symmetrically with respect to each other so that the tuning of the antenna will not affect the other electrical characteristics of the antenna apart from the resonance frequency. With the method according to the invention there is no risk of producing conductive chips resulting from the working of metallic elements, the tuning of the antenna becomes accurate, and structural faults in the medium will be automatically compensated for.

11 Claims, 4 Drawing Sheets

METHOD FOR TUNING AN ANTENNA AND AN ANTENNA

The invention relates to a method for tuning dielectric antennas designed for operation especially in the microwave range. The invention also relates to an antenna structure and an apparatus in which the method is applied.

As portable apparatus comprising radio parts become more popular and smaller in size, also the antennas in them have to be small, located preferably within the covers of the apparatus. As frequencies higher than before are utilized, antennas naturally get smaller. For example, use of frequencies above the 2.4 GHz band is increasing. The size of the antenna structure can be further reduced through design. The structure may e.g. include planar elements and a dielectric medium. The smaller such an antenna, which deviates from the simple monopole, the more difficult it is to get its electrical characteristics within the limits specified. So, the drawback of a small antenna size is the difficulty of its fabrication.

Figure 1:
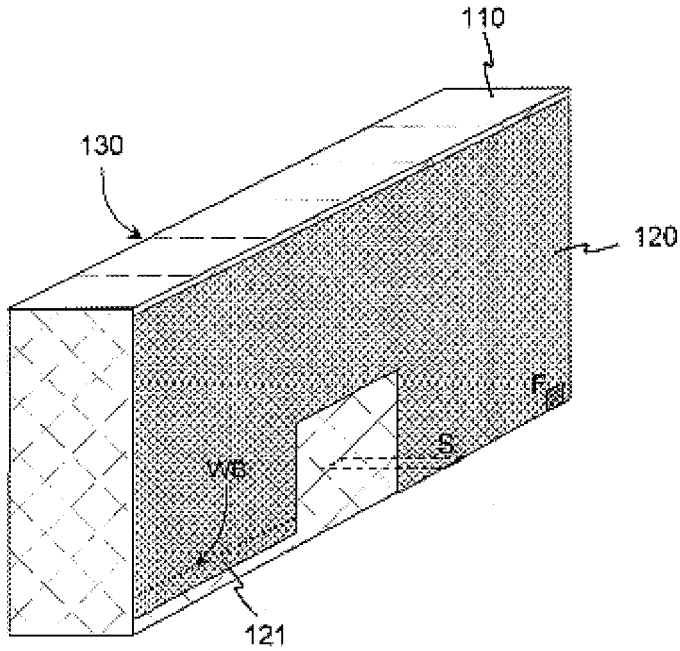
Fig. 1 PRIOR ART

The last phase in the manufacture of an antenna is the tuning of the antenna, i.e. making the resonance frequency or frequencies of the antenna exactly match the operating bands. The invention is directed to structures in which the radiating element of an antenna is a conductive layer on a surface of a dielectric board. In such antennas, the factor most contributing to the need of tuning is deviation in the thickness of the dielectric board. From the prior art a tuning method is known in which part of the radiating element is removed through mechanical working or by means of a laser beam. As the element size thus is reduced, the resonance frequency of the corresponding part of the antenna structure increases. Naturally the element originally has to be large enough so as to have a safe tuning margin. FIG. 1 depicts the aforementioned prior-art method and structure. There is a board-like dielectric block 110. On a first surface thereof, shown in the front, there is a radiating element 120 to a point F of which an antenna feed conductor is connected. On the opposing surface of the dielectric board there is a ground plane 130, or a conductive layer connected to the ground potential. The radiating element is short-circuited at a point S to the ground plane, which means the antenna is a planar inverted F antenna, or PIFA for short. In the example of FIG. 1 the radiating element 120 forms a thick II-shaped pattern on one end of which there are the aforementioned feed point and short-circuit point. The resonance frequency of the antenna is determined by the electrical length of the pattern. When tuning the antenna, part of the radiating element is removed from the end opposite to the feed point F, thereby decreasing the electrical length of the element. The figure shows an exemplary working border WB parallel to the end line of the element. Between the working border and the end of the element there is the conductive strip 121 to be removed.

A disadvantage of the method is that it is relatively inaccurate: Removing even a small amount of conductive material considerably changes the resonance frequency of the antenna. For example, in an antenna operating approximately at 2.5 GHz, the removal of a conductive strip one millimeter wide at the end of the element may change the resonance frequency for more than 100 MHz. Another disadvantage is that working the conductive layer may leave small conductive chips in the structure, risking a short-circuit as relatively strong electric fields occur in the antenna. If a laser beam is used in the working, an additional disadvantage is that a protection arrangement is required for the worker because when metal is removed by laser, plastic material is vaporized at the same time.

An object of the invention is to provide a novel and more advantageous method of tuning a dielectric antenna. A method according to the invention is characterized by that which is expressed in the independent claim 1. An antenna structure according to the invention is characterized in that which is expressed in the independent claim 5. An apparatus according to the invention is characterized in that which is expressed in the independent claim 10. Advantageous embodiments of the invention are disclosed in the other claims.

The basic idea of the invention is as follows: An antenna is tuned by removing material from a dielectric block placed between conductive elements. The removal of dielectric material decreases the average dielectric constant in the space between the conductive planes, resulting in an increase in the resonance frequency of the antenna. The antenna is advantageously fabricated such that the conductive elements on the opposing surfaces of the dielectric block are shaped identical and are located symmetrically with respect to each other so that the tuning of the antenna will not affect the other electrical characteristics of the antenna but the resonance frequency only.

An advantage of the invention is that the method according to the invention enables accurate tuning of an antenna since removing a small amount of material from the dielectric medium changes the resonance frequency of the antenna only relatively little. Another advantage of the invention is that with the method according to the invention, structural defects in the dielectric medium will be automatically compensated for. A further advantage of the invention is that the working of the dielectric material will never produce additional small conductive formations in the antenna structure. A further advantage of the invention is that plastics which usually are used as dielectric material are easy to work. A further advantage of the invention is that the mechanical working of the plastic will not require protection of the worker. A further advantage of the invention is that the antenna is easy to tune even in the finished product, because tuning only requires an access to one side of the antenna. A further advantage of the invention is that with the structure according to it the tuning of the antenna will not affect other electrical characteristics than the resonance frequency.

Figure 3:
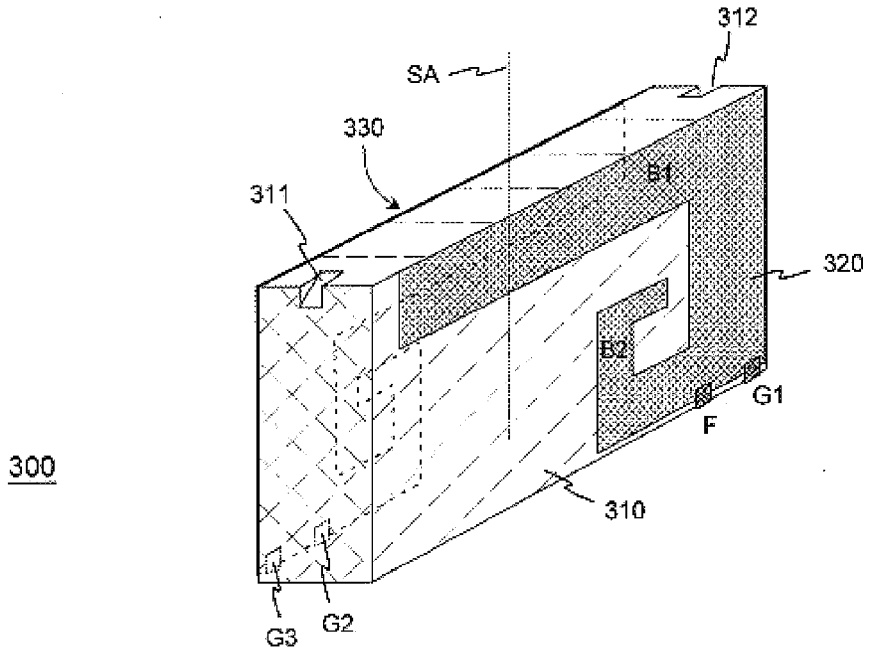
Figure 4:
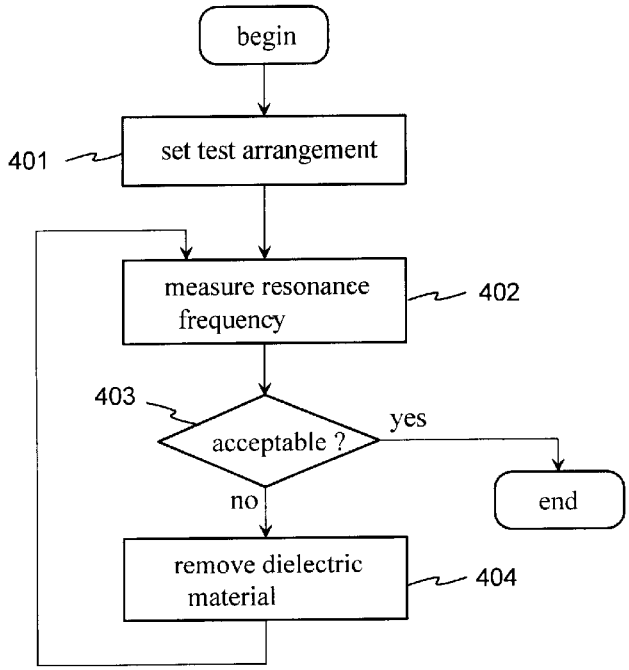
Figure 5:
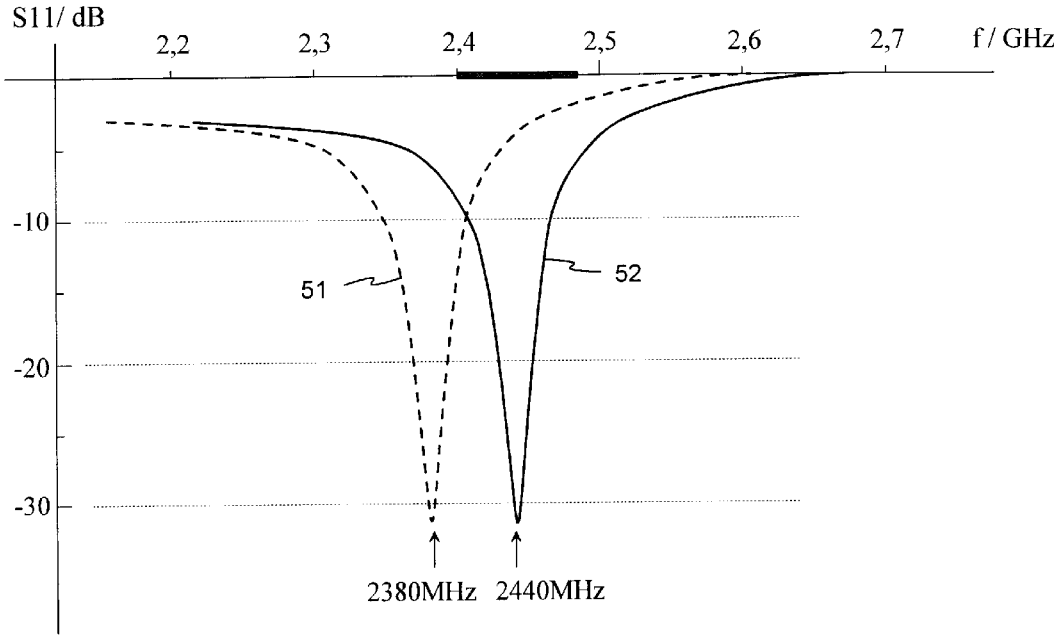
Figure 6:
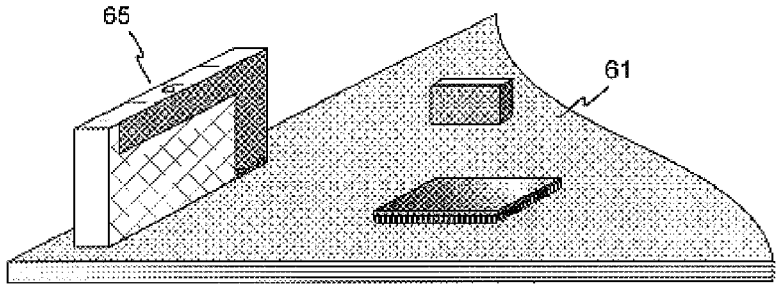
Figure 7:
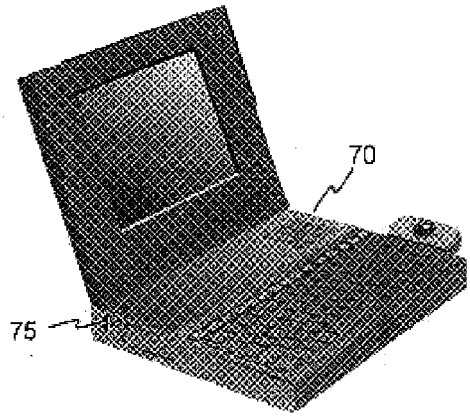

The invention is described in closer detail in the following. In the description, reference is made to the accompanying drawings in which FIG. 1 shows an example of a prior-art antenna structure and the tuning thereof, FIG. 2 shows an example of an antenna structure according to the invention and the tuning thereof, FIG. 3 shows a second example of an antenna structure according to the invention and the tuning thereof, FIG. 4 shows in the form of flow diagram a tuning method according to the invention, FIG. 5 shows an example of the effect of the tuning according to the invention on the amplitude response, FIG. 6 shows an example of the placement of an antenna according to the invention in an apparatus, and FIG. 7 shows an example of an apparatus equipped with an antenna according to the invention.

FIG. 1 was already discussed in connection with the description of the prior art.

Figure 2:
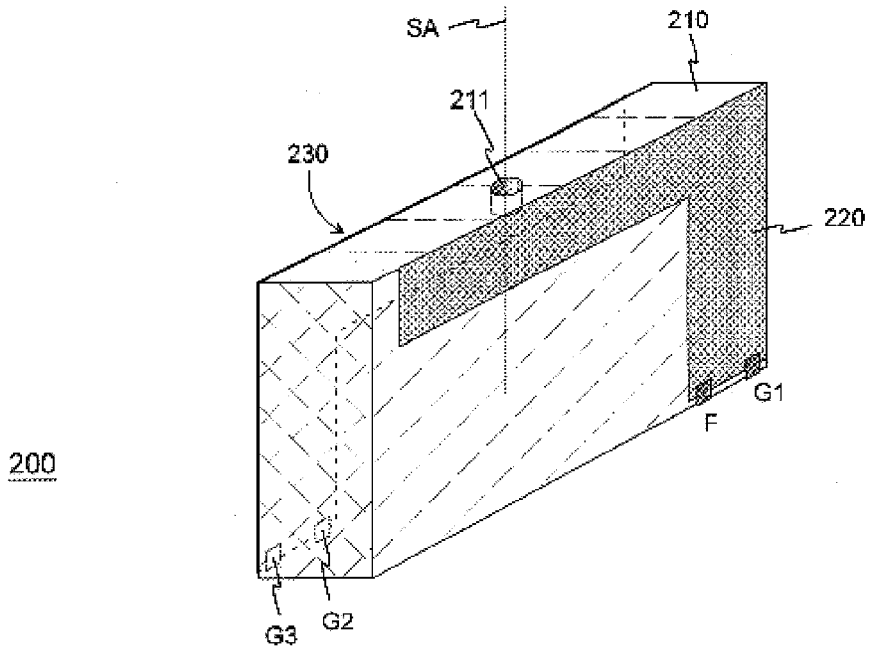

FIG. 2 shows an example of a tuned antenna structure according to the invention. The antenna structure 200 comprises a board-like dielectric block 210, a planar radiating element 220 on a first surface thereof, shown here in the front, and a planar second antenna element 230 on a second, opposing, surface of the dielectric board. In this example, the radiating element has two straight portions at a 90-degree angle. The longer portion is shown to be located near the top edge of the dielectric board 210 and parallel to the longest side of the board, i.e. longitudinal. The shorter portion extends in the vertical direction close to the bottom edge of the dielectric board. At the end below the shorter portion there are, relatively close to one another, a feed point F of the antenna structure and a point G1 connected to the ground potential. Conductors in the ground potential may be called the signal ground. The second antenna element 230 is shaped identical with the radiating element. In accordance with the invention these two elements are located symmetrically so that their shorter portions are at the opposing ends of the dielectric board, with respect to the longitudinal direction, and the longer portions are for the most part face to face at the upper part of the dielectric board. Thus the elements have a vertical symmetry axis SA in the center of the antenna structure. The second antenna element is connected to the ground potential at points G2 and G3 whose locations correspond to those of points F and G1 in the radiating element. The second antenna element has no other galvanic connections.

Attributes "top" and "bottom" as well as "vertical" and "horizontal" refer in this description and in the claims to the position of the antenna shown in FIG. 2 and are in no way connected with the operating position of the apparatus.

The antenna is tuned by removing material from the dielectric board 210. In the example of FIG. 2, the removal is done in the middle of the horizontal top face of the dielectric board, on the symmetry axis SA of the conductive antenna elements. The removal of material has left a cylindrical hollow 211. Tuning is based on the fact that the fundamental resonance frequency of the structure increases when the dielectricity in the space between the antenna elements is reduced. The dielectricity of air is lower than that of the solid materials used. So, because of the hollow 211, the average dielectric constant of the space between the antenna elements is smaller than before the working of the board.

The dielectric board may be worked mechanically e.g. by means of drilling. A laser may also be used. The shape of the hollow produced may naturally be something other than a cylinder as long as the antenna elements are located symmetrically with respect to the hollow.

FIG. 3 shows a second example of an antenna structure according to the invention and the tuning thereof. The antenna structure 300 is like that in FIG. 2 with the exception that in this example the radiating element 320, as viewed from the feed point of the antenna, has two branches: It has a branch B1 shaped like the element in FIG. 2, and a second, shorter branch B2 in order to provide a second operating band. A ground element 330 on the other side of the dielectric board 310 is again shaped identical with the radiating element. The antenna structure 300 is tuned by removing material at two locations. The points of removal are located symmetrically with respect to each other, relative to the symmetry axis SA of the antenna elements. In this example the points of removal are located in the corners of the upper face and end faces of the dielectric board. The longitudinal sections of the hollows 311 and 312, produced by working the material, are triangular in this example. If the antenna is a dual-band antenna, the tuning according to the invention can be used to set one band, the other band has to be set by some other means.

FIG. 4 illustrates in the form of flow diagram a tuning method according to the invention. In step 401 preparations for the tuning are made: The antenna structure is placed in the working apparatus so that dielectric material can be removed from the symmetry axis of the structure or from points located symmetrically with respect to each other, relative to the symmetry axis. Furthermore, in step 401 test equipment, such as a network analyzer, is electrically connected to the antenna. In step 402 the fundamental resonance frequency of the antenna is measured. It is compared, in step 403, to the nominal resonance frequency corresponding to the band specified. If the resonance frequency measured is significantly below the nominal resonance frequency, the working apparatus is used to remove dielectric material in the manner described above (step 404). The amount of material removed is e.g. proportional to the difference of the nominal resonance frequency and the resonance frequency measured. It is also possible to always remove a small constant amount at a time. The process then returns to step 402. The cycle consisting of steps 402, 403 and 404 is repeated until the resonance frequency measured equals the nominal resonance frequency with a sufficient accuracy.

FIG. 5 shows an example of the effect of the tuning according to the invention on the amplitude response of an antenna structure. There are shown two curves 51 and 52 which represent the reflection coefficient S11 of the antenna structure as a function of frequency. Curve 51 applies to the situation prior to the tuning, and curve 52 applies to the situation after the tuning. The antenna in question is intended to be used in communication devices employing the frequency band of 2400 to 2484 MHz. The curves and the associated resonance frequencies show that a band, which originally was offset by about 60 MHz, has been corrected by tuning. The results presented in FIG. 4 apply to a structure according to FIG. 2 where the dielectric board 210 is made of ordinary printed circuit board material.

FIG. 6 shows an example of the placement of an antenna structure according to the invention in an apparatus using it. The apparatus comprises a printed circuit board 61. An antenna 65 is attached to the printed circuit board 61 by its longitudinal side so that a plane parallel to the antenna elements is perpendicular to the printed circuit board. Attachment is realized e.g. by soldering at least the feed point and the grounding points of the antenna structure to via holes or conductive patches in the printed circuit board.

FIG. 7 shows an apparatus that includes an antenna structure according to the invention. The apparatus is in this example a portable computer 70 equipped e.g. with a wireless local area network (WLAN) interface. The antenna structure 75 is located on a printed circuit board internal to the computer 70. Antennas according to the invention may also be placed in the apparatus in twos, applying space diversity.

Above it was described antenna structures according to the invention and a tuning method for those. The antenna structure may differ from those described. For example, the shapes of the antenna elements may be different and they may be placed asymmetrically. Similarly, the tuning method may in some details differ from that described. Material may be removed from other places than the symmetry axis; if there is no symmetry axis, this is naturally the case. Moreover, the invention does not limit the fabrication method of the antenna, nor the materials used therein. The material may also be a ceramic, for example. The inventional idea can be applied in different ways within the limits defined by the independent claims 1, 5 and 10.

What is claimed is:

1. A method for tuning an antenna structure which comprises a dielectric block and a conductive antenna element on two opposing surfaces of the dielectric block, in which method the resonance frequency of the antenna structure is measured and material is removed from the antenna structure in order to increase the resonance frequency, wherein removal of material is directed to the dielectric block, and dielectric material is removed until the measured resonance frequency of the antenna structure has reached with a certain accuracy the nominal resonance frequency corresponding to the band specified for the antenna structure.

2. A method according to claim 1, the conductive antenna elements being identical and being located, in relation to each other, such that a symmetry axis is situated between them, wherein dielectric material is removed from the symmetry axis.

3. A method according to claim 1, the conductive antenna elements being identical and being located, in relation to each other, such that a symmetry axis is situated between them, wherein dielectric material is removed from points located in pairs symmetrically with respect to each other, relative to the symmetry axis.

4. A method according to claim 1, the amount of dielectric material removed at a time being proportional to the difference of the nominal resonance frequency and the resonance frequency measured.

5. An antenna structure comprising a dielectric block, a first conductive antenna element on a first surface of the dielectric block, and a second conductive antenna element on a second, opposing, surface of the dielectric block, which first conductive antenna element has a point to be connected to a feed conductor of the antenna structure and a point to be connected to signal ground, wherein the second conductive antenna element has at least one point to be connected to signal ground, and the first and the second conductive antenna elements are substantially equal in size to tune the antenna structure by changing the form of the dielectric block.

6. An antenna structure according to claim 5, the first and the second conductive antenna element being equal in size, identically shaped and located, with respect to each other, such that a symmetry axis is situated between them, and the second conductive antenna element having two points to be connected to signal ground and being, relative to the symmetry axis, located symmetrically with respect to said points in the first conductive antenna element to be connected to a feed conductor of the antenna structure and to signal ground.

7. An antenna structure according to claim 5, the dielectric block being a printed circuit board.

8. An antenna structure according to claim 5, the material of the dielectric block being a ceramic.

9. An antenna structure according to claim 5, the material of the dielectric block being a plastic.

10. An apparatus with an antenna comprising a dielectric block, a first conductive antenna element on a first surface of the dielectric block, and a second conductive antenna element on a second, opposing, surface of the dielectric block, which first antenna element has a point to be connected to a feed conductor of the antenna and a point to be connected to signal ground, wherein the second conductive antenna element has at least one point to be connected to signal ground, and the first and the second conductive antenna elements are substantially equal in size to tune the antenna structure by changing the form of the dielectric block.

11. An apparatus according to claim 10, being a portable computer.

* * * * *